United States Patent [19]

Nakai

[11] Patent Number: 4,755,141

[45] Date of Patent: Jul. 5, 1988

[54] TOY FOR SIMULATING THE SOUND AND FEEL OF CUTTING FOOD

[75] Inventor: Hideki Nakai, Tokyo, Japan

[73] Assignee: Toho Kako Co., Inc., Japan

[21] Appl. No.: 66,190

[22] Filed: Jun. 25, 1987

[51] Int. Cl.[4] ..... A63H 33/00; G09B 19/00

[52] U.S. Cl. ..... 434/258; 273/DIG. 30; 434/127; 446/491; 446/901

[58] Field of Search ..... 434/258, 127; 273/157 R, DIG. 30; 446/901

[56] References Cited

U.S. PATENT DOCUMENTS 3,316,669 5/1967 Nachbar ..... 446/901

FOREIGN PATENT DOCUMENTS 1257666 12/1971 United Kingdom ..... 273/157 R

*Primary Examiner*—William H. Grieb

*Attorney, Agent, or Firm*—Steele, Gould & Fried

[57] ABSTRACT

The present invention relates to toys for use of children which are models of green vegetables, fruits and the like. The model vegetables are cut into blocks and are temporarily adhered together. The model vegetables can be separated into several blocks by using a model edged tool. The model blocks each include a facing section and the facing sections of adjacent blocks are capable of being temporarily adhered to simulate a whole fruit or vegetable. A chink is formed at the periphery of the joining portions of adjacent blocks in the model to be cut to receive and guide the edge of a model tool. The plural blocks in the model to be cut are temporarily adhered mutually by a hook-and-loop fastening means so as to simulate the feel and sound of a fruit, vegetable or the like being cut.

2 Claims, 2 Drawing Sheets

TOY FOR SIMULATING THE SOUND AND FEEL OF CUTTING FOOD

BACKGROUND OF THE INVENTION

1. Field of the Invention

The present invention relates generally to toys, and more particularly, relates to toys which are models of green vegetables, fruits and the like which are cut into pluralities of blocks. The blocks are capable of being temporarily adhered and then separated by a child by using a model edged tool such as a simulated kitchen knife, a knife or the like.

2. Description of the Prior Art

In the customary toys for child, use so-called block toys or puzzle games are known. Such toys are characterized by constructions wherein the blocks have fixed shapes and may simply be laminated. In other block type toys, articles or structures and the like are constructed and constituted by arranging in a row. Block type toys having previously constructed and constituted articles or structures which were designed to be divided by hand have also been developed by prior workers in the art.

However, even when children have played with these prior art block type, customary toys, upon reaching adulthood, the previous block type toys provided no kitchen or related training or experience. A serious situation can arise wherein an adult cannot master the use of a kitchen knife or cannot skillfully use other types of knives.

In spite of the fact that an edged tool can be a safe article when properly used, the fact that children are usually kept away or are prohibited from using an edged tool because of a preconception that the edged tool is dangerous simply is a cause for this situation.

SUMMARY OF THE INVENTION

The present invention is a quite new technique in which the above-mentioned customary controversial points were solved fundamentally. More particularly, the present invention relates to toys which are models of to be cut vegetables, fruits and the like. The models are previously divided into several blocks and the blocks are temporarily adhered mutually by a hook-and-look fastener. A child can separate the model vegetable into several blocks by using a model edged tool.

DESCRIPTION OF THE PREFERRED EMBODIMENT OF THE INVENTION

Figure 1:
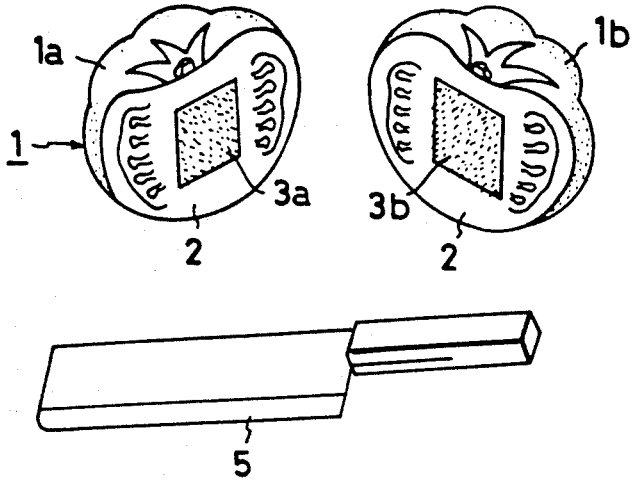
FIG. 1 is a perspective explanatory view showing a toy construction in accordance with the present invention.

Referring now to an embodiment of the toy in accordance with the present invention, numeral 1 in FIG. 1 indicates a model to be cut made of plastic having the shape of a tomato. The model is previously divided into two blocks 1*a* and 1*b* of which said model 1 is constituted. The central parts of the facing sections 2 of these blocks 1*a* and 1*b* are provided with the velvet fasteners (magic tapes) 3*a* and 3*b* (such as a "Velcro" type faster) which are capable of mutually adhering in known manner. Therefore, the model 1 to be cut in accordance with the present invention can be constructed to the shape of a tomato by temporarily adhering the two blocks 1*a* and 1*b* interiorly by means of adhesion of the velvet fasteners (magic tapes) 3*a* and 3*b*.

Figure 2:
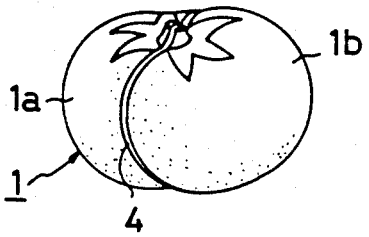
FIG. 2 is a perspective view showing a situation in which a pair of divided blocks of the toy are temporarily adhered.

The joining portions of the blocks 1*a* and 1*b* when adhered temporarily define between them a chink 4 which is equal to the thickness of the velvet fasteners (magic tapes) 3*a* and 3*b*, as shown in FIG. 2. The numeral 5 indicates the model edged tool which preferably is configured in the shape of a kitchen knife.

Figure 3:
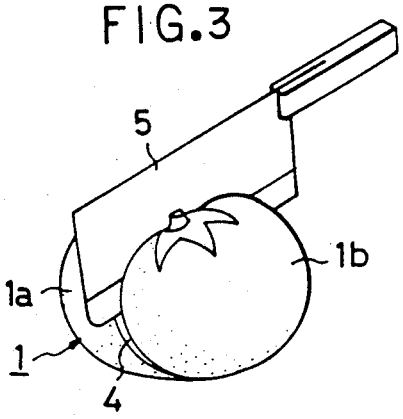
FIG. 3 is a perspective view showing a situation in which the model to be cut is cut by using a model edged tool.

On the occasion when a toy constructed in accordance with the present invnetion is used by a child, it is possible that the model 1 to be cut can be separated into the left and right blocks 1*a*, 1*b* by pushing with sufficient downward force while the edge of the model edged tool 5 is inserted in the chink 4 of the model 1, as shown in FIG. 3.

Figure 4:
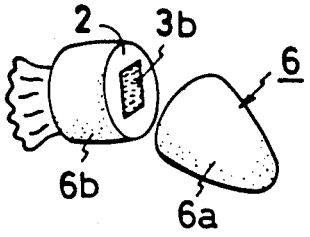
FIG. 4 is a perspective view showing the model to be cut having the shape of a carrot.
Figure 6:
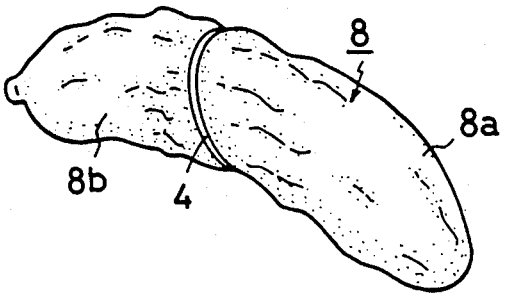
FIG. 6 is a perspective view showing the model to be cut having the shape of a cucumber.
Figure 5:
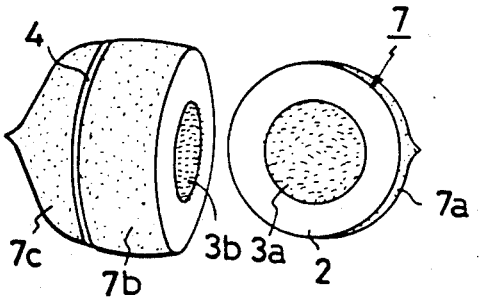
FIG. 5 is a perspective view showing the model to be cut having the shape of a lemon.

In the above-mentioned embodiment, the explanation was set forth with regard to the model 1 having the shape of a tomato. It will be appreciated that other models having various shapes can be similarly used by being configured to simulate other articles. For example, a model 6 having the shape of a carrot consisting of blocks 6*a* and 6*b* is shown in FIG. 4; or a model 7 having the shape of a lemon consisting of blocks 7*a*, 7*b* and 7*c* is shown in FIG. 5; or a model 8 having the shape of a cucumber consisting of blocks 8*a* and 8*b* shown in FIG. 6 can be employed.

In the present invention, since the width of the chink 4 is approximately the same thickness as that of the velvet fasteners (magic tapes) and the chink is defined when the temporarily adhered joining portions of the blocks 1*a*, 1*b*, 6*a*, 6*b*, 7*a*, 7*b*, 7*c*, and 8*a* which comprise each embodiment of the model to be cut are adhered, it is possible for the child user (not shown) to insert the sharpened edge of the tool 5 easily and accurately in the chink. Since the blocks which comprise each unit or embodiment are temporarily adhered mutually by an attachment of the velvet fasteners (magic tapes) 3*a*, 3*b*, the model edged tool can be wedged between each pair of the adhered blocks gradually. As both sides of the velvet fasteners (magic tapes) are disconnected, the model edged tool will fall quickly to the bottom. Accordingly, the child using the toy of the present invention can experience the feel and sense of green vegetables as they are cut by using an edged tool.

Therefore, the present invention has the following characteristics. It is possible that the way to use an edged tool is comprehended and understood as the child plays with the model toys in accordance with the present invention. There will be no danger when an edged tool is really used when the child grows into a man or woman, and then it is possible the the grown-up will master the use of an edged tool spontaneously.

What is claimed is:

1. In a toy comprising a model of simulated fruit, vegetable or the like and a simulated edged tool, said simulated fruit, vegetable or the like being divided to define at least a pair of blocks, each block having a facing section, the improvement which comprises said blocks being temporarily joined at their respective facing sections by a hook-and-loop fastening means for providing the blocks when parted with the simulated edged tool with the feel and sound of a fruit, vegetable or the like being cut.

2. A toy according to claim 1 wherein the fasteners cover only a portion of the facing sections and not the entire facing sections.

* * * * *

US004755141C1

(12) REEXAMINATION CERTIFICATE (4801st)

United States Patent

Nakai

(10) Number: US 4,755,141 C1

(45) Certificate Issued: Jul. 1, 2003

(54) TOY FOR SIMULATING THE FEEL AND SOUND OF CUTTING FOOD

(75) Inventor: Hideki Nakai, Tokyo (JP)

(73) Assignee: Moku Co., Ltd., Tokyo (JP)

Reexamination Request:
No. 90/006,188, Jan. 14, 2002

Reexamination Certificate for:

| | |
|---|---|
| Patent No.: | **4,755,141** |
| Issued: | **Jul. 5, 1988** |
| Appl. No.: | **07/066,190** |
| Filed: | **Jun. 25, 1987** |

(51) Int. Cl.[7] ..... A63H 33/00; G09B 19/00

(52) U.S. Cl. ..... 434/258; 434/127; 273/DIG. 30; 446/491; 446/901

(56) References Cited

FOREIGN PATENT DOCUMENTS

JP 59-76298 5/1984

*Primary Examiner*—John Edward Rovnak

(57) ABSTRACT

The present invention relates to toys for use of children which are models of green vegetables, fruits and the like. The model vegetables are cut into blocks and are temporarily adhered together. The model vegetables can be separated into several blocks by using a model edged tool. The model blocks each include a facing section and the facing sections of adjacent blocks are capable of being temporarily adhered to simulate a whole fruit or vegetable. A chink is formed at the periphery of the joining portions of adjacent blocks in the model to be cut to receive and guide the edge of a model tool. The plural blocks in the model to be cut are temporarily adhered mutually by a hook-and-loop fastening means so as to simulate the feel and sound of a fruit, vegetable or the like being cut.

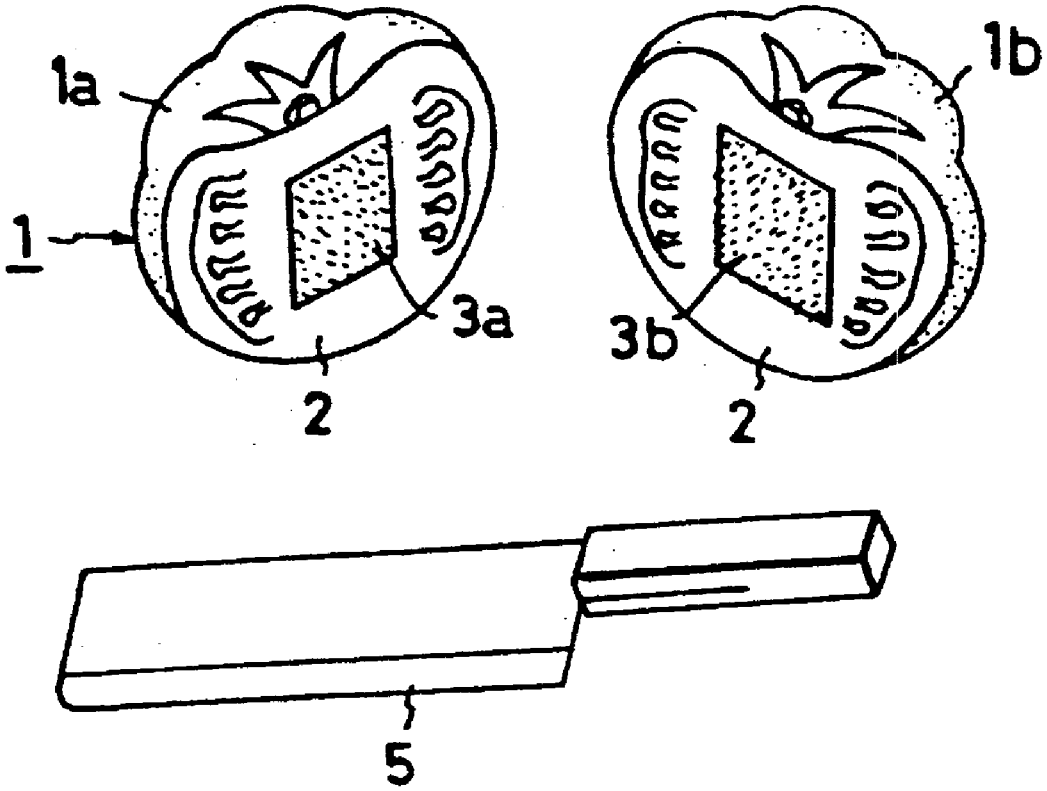

REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1 and 2 are cancelled.

* * * * *